US011498116B2

(12) United States Patent
Ackermann et al.

(10) Patent No.: US 11,498,116 B2
(45) Date of Patent: Nov. 15, 2022

(54) STRETCH ROLLING METHOD AND STRETCH ROLLING UNIT

(71) Applicant: SMS Group GmbH, Duesseldorf (DE)

(72) Inventors: Stephan Ackermann, Moenchengladbach (DE); Markus Schaprian, Moenchengladbach (DE); Frederik Knauf, Moenchengladbach (DE)

(73) Assignee: SMS Group GmbH, Duesseldorf (DE)

( * ) Notice: Subject to any disclaimer, the term of this patent is extended or adjusted under 35 U.S.C. 154(b) by 23 days.

(21) Appl. No.: 16/496,016

(22) PCT Filed: Jan. 31, 2018

(86) PCT No.: PCT/DE2018/100074
§ 371 (c)(1),
(2) Date: Sep. 20, 2019

(87) PCT Pub. No.: WO2018/171828
PCT Pub. Date: Sep. 27, 2018

(65) Prior Publication Data

US 2020/0023426 A1 Jan. 23, 2020

(30) Foreign Application Priority Data

Mar. 22, 2017 (DE) ..... 10 2017 106 227.0
Jul. 21, 2017 (DE) ..... 10 2017 116 570.3

(51) Int. Cl.
*B21H 1/22* (2006.01)
*B21J 13/12* (2006.01)
(Continued)

(52) U.S. Cl.
CPC ..... *B21J 13/12* (2013.01); *B21D 1/05* (2013.01); *B21H 1/22* (2013.01); *B21H 9/00* (2013.01)

(58) Field of Classification Search
CPC ..... B21B 39/04; B21B 39/06; B21B 39/20; B21B 39/24; B21J 5/00; B21J 9/02;
(Continued)

(56) References Cited

U.S. PATENT DOCUMENTS 33,155 A * 8/1861 Miller ..... B21H 1/22 72/188
3,841,139 A * 10/1974 Bachmann ..... B21J 13/10 72/420
(Continued)

FOREIGN PATENT DOCUMENTS

CN 101549384 A 10/2009
CN 102 274 921 A 12/2011
(Continued)

OTHER PUBLICATIONS

Translation; DE 3507250 C1, Sep. 1986.*
(Continued)

*Primary Examiner* — Edward T Tolan
(74) *Attorney, Agent, or Firm* — Collard & Roe, P.C.

(57) ABSTRACT

A stretch rolling method and a stretch rolling unit can roll out any gripping ends and uses the narrowest possible installation space. In the stretch rolling method, a workpiece is successively fed to at least two passes of a stretch rolling unit of a gripping device, wherein the workpiece is rotated by 180° about an axis of rotation lying perpendicular to the main direction of extent of the workpiece between the first pass of the two passes and the second pass of the two passes.

16 Claims, 9 Drawing Sheets

Figure 1:
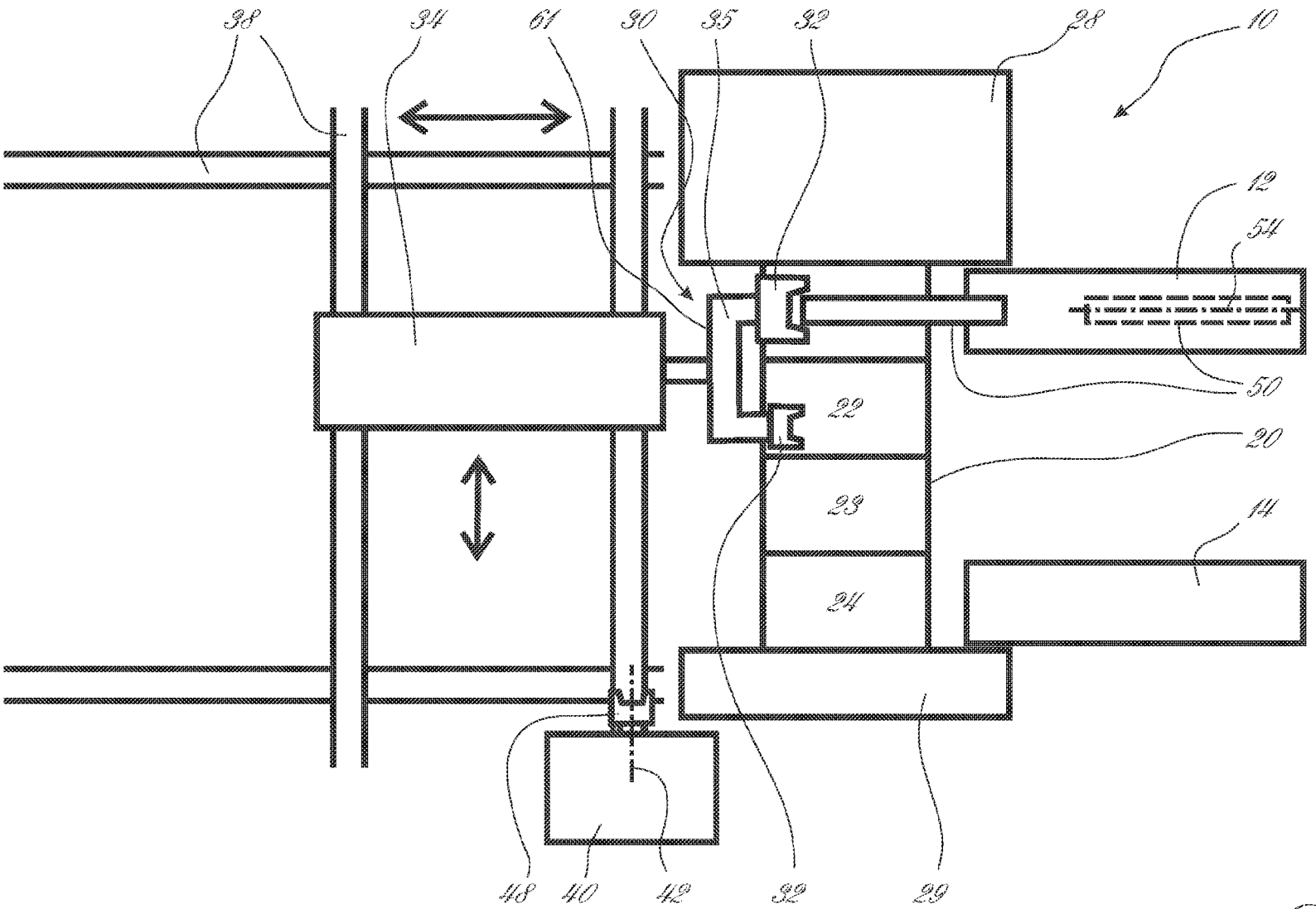

(51) Int. Cl.
*B21D 1/05* (2006.01)
*B21H 9/00* (2006.01)

(58) Field of Classification Search
CPC .. B21J 13/10; B21J 13/12; B21H 9/00; B21H 1/20; B21H 1/22; B21D 1/05; B21K 27/00; B21K 27/02; B21K 27/04
See application file for complete search history.

(56) References Cited

U.S. PATENT DOCUMENTS

| | | | | |
|---|---|---|---|---|
| 4,084,418 | A * | 4/1978 | Willenbrock | B21J 13/10 72/31.01 |
| 6,678,574 | B2 * | 1/2004 | Fujii | B21J 1/04 29/897.2 |

FOREIGN PATENT DOCUMENTS

| | | | | |
|---|---|---|---|---|
| CN | 106 424 510 | A | 2/2017 | |
| DE | 22 48 182 | C2 | 4/1984 | |
| DE | 35 04 774 | C1 | 6/1986 | |
| DE | 3507250 | C1 * | 9/1986 | B21J 9/00 |
| DE | 10 2014 101 150 | A1 | 7/2015 | |
| DE | 10 2014 101151 | A1 | 7/2015 | |
| DE | 10 2013 100 302 | B4 | 2/2017 | |
| EP | 2 316 589 | B1 | 9/2012 | |
| GB | 1080714 | A * | 8/1967 | B21H 1/22 |
| JP | H04-55036 | A | 2/1992 | |
| WO | 2014/081288 | A1 * | 5/2014 | B21B 39/24 |
| WO | 2016/207016 | A1 | 12/2016 | |

OTHER PUBLICATIONS

International Preliminary Report on Patentability and Written Opinion of the International Searching Authority in PCT/DE2018/100074, dated Oct. 3, 2019 with English Translation.

Xu Chunguo et al, Process of turning-around roll forging preforming for locomotive precision forging connecting rod, pp. 483-485, Collected papers of the 8th national plastic processing academic annual conference, Nov. 1, 2002.

International Search Report in PCT/DE2018/100074, dated May 28, 2018.

LASCO Umformtechnik GmbH: Automatisierung [Automation] Edition Oct. 2012, 14 pages.

Chinese Office Action in Chinese Application No. 201880033894.0 dated Oct. 19, 2020 with English translation.

* cited by examiner

STRETCH ROLLING METHOD AND STRETCH ROLLING UNIT

CROSS REFERENCE TO RELATED APPLICATIONS

This application is the National Stage of PCT/DE2018/100074 filed on Jan. 31, 2018, which claims priority under 35 U.S.C. § 119 of German Application Nos. 10 2017 106 227.0 filed on Mar. 22, 2017 and 10 2017 116 570.3 filed on Jul. 21, 2017, the disclosures of which are incorporated by reference. The international application under PCT article 21(2) was not published in English.

The invention relates to a stretch rolling method and to a stretch rolling unit.

Stretch rolling methods and stretch rolling units are generally integrated into die-forging machines and serve there for distribution of mass, with the goal of increasing the degree of material utilization. For this purpose, the blank is reshaped in multiple passes, between rolling tools that rotate in opposite directions, along the longitudinal axis of the blank.

In this regard, for example, stretching rolls from the SMS company, for example in the models ARWS and RWW, or in other conventional machines, are sufficiently known, for example also from DE 10 2013 100 302 B4, wherein there is one end of the respective workpiece that is not rolled or cannot be rolled. This ultimately leads to a poor degree of material utilization. This also holds true for the company publication LASCO Umformtechnik GmbH: Automatisierung [Automation]. Edition October 2012, p. 12-13, for DE 10 2014 101 150 A1, for WO 2016/207 016 A1, for DE 22 48 182 C2, and for DE 35 04 774 C1, wherein in the publications, the workpiece is handled by means of a manipulator, in each instance.

The arrangement according to EP 2 316 589 B1 makes it possible to roll out the gripping end or ends.

It is the task of the present invention to make available a stretch rolling method and a stretch rolling unit, in the case of which rolling out of any gripping ends can also be made possible, at the narrowest possible construction space.

As a solution, stretch rolling methods and stretch rolling units having the characteristics of the independent claims are proposed, which are accordingly advantageous cumulatively or alternatively. Further advantageous embodiments are found in the dependent claims, the present description, as well as the attached drawing.

Use for the production of finished parts, using stretch rolling units or stretch rolling methods that work with existing machines or without integration into more comprehensive machines, or stretch rolling units or stretch rolling methods that are used for other purposes, are conceivable, in general, using the proposed solution.

Furthermore, the proposed solution leads to an increase in the degree of material utilization, in comparison with the state of the art, in the case of suitable method management. Furthermore, the non-rolled gripping end, in the case of the machines known from the state of the art, generally prevents the stretch rolling method from being used for the production of finished parts. The present solution counteracts this, in the case of a suitable design.

In the state of the art, the start of rolling also does not appear to be process-stable. There, drive is supposed to take place by way of a direct drive, which requires high power input. Due to two required manipulators, which furthermore must perform a longitudinal movement, the machine width becomes very great. This is also counteracted by the present solution, in the case of a suitable design.

In the case of a suitable design, a stretch rolling method or a stretch rolling unit can be created, which makes stretch rolling free of gripping ends possible, wherein a) it is possible to do without a reversal of direction of the rolls between two passes—as a result, a flywheel drive can furthermore be used, if applicable, without any further switchable gear mechanism for reversal of the direction of rotation, and no direct drives having a high power input have to be used—, b) process-stable initial rolling can be guaranteed in every pass, and c) one side of the roll stand can remain free of manipulators, for the purpose of parts transport in and out, as well as the purpose of accessibility during replacement of the rolling tool (in this way, the machine width is reduced).

In this way, depending on the concrete embodiment, after the rolling blank or the workpiece was rolled, it can be laid down onto a rotation device and rotated in such a manner that a gripping device can grip the end of the rolling blank that has already been rolled, and the end of the rolling blank that was not yet rolled can be rolled. A reversal of the direction of rotation of the rolls is not necessary, in this regard, and the use of a flywheel is actually possible, if applicable.

The axis of rotation can be disposed vertically in the machine concept, for example mounted below the rolling plane, in the foundation or machine frame, or in a portal above the rolling plane, or alternatively also horizontally at a right angle to the longitudinal axis of the blank in the gripping direction.

Cumulatively or alternatively, it can be provided that the gripping device has a gripper that has such a large gripping range that the unformed end and the end that has already been rolled can be gripped. Alternatively to this, it is also conceivable that the gripping device is equipped with more than one gripper, so as to be able to grip different diameters or geometries, if necessary.

The proposed solution, in the case of a suitable design, makes an increase in the degree of material utilization possible, in particular, when used as a pre-forming assembly and, if applicable, also use of the stretching roll for the production of finished parts, for example railroad axles, in particular. In this regard, the tolerances and surface grades to be achieved are clearly better than with conventional methods (for example forging), which are currently being used for the production of such finished parts. The cycle time in the production of railroad axles can be almost cut in half, for example. The required drive power and the machine size can be selected to be minimal.

In this way, a stretch rolling method in which a workpiece is successively passed to at least two passes of the stretch rolling unit by means of a gripping device, can be characterized in that the workpiece is rotated by 180°, about an axis of rotation that lies perpendicular to the main expanse direction of the workpiece, between the first pass of the two passes and the second pass of the two passes.

Such a rotation of the workpiece accordingly allows the non-rolled gripping end of the workpiece to be fed to the stretch rolling unit and also to be rolled during the two passes.

It is advantageous that such a rotation of the workpiece makes it possible that the non-rolled gripping end can also be rolled, and that processing of the previously non-rolled gripping end can take place in the second pass, by means of the rotation of the workpiece, so that a second manipulator on the side of the non-rolled gripping end and a further pass are not necessary, for example. Rotation of the workpiece allows rolling of the non-rolled gripping end in the simplest possible manner and within a confined space.

Also, the stretch rolling method can be characterized in that rotation takes place by way of a rotation device, and that the gripping device transfers the workpiece to the rotation device for rotation between the passes, and takes it over again from the rotation device after rotation.

In this regard, the method makes use of the rotation device and the gripping device, wherein the gripping device serves to transfer the workpiece to the rotation device between the passes, where the actual rotation procedure of the work procedure takes place, and the gripping device then takes over the workpiece, which has been rotated by 180°, from the rotation device and passes it to the corresponding pass for further processing.

In this way, rotation of the workpiece can take place in simple manner, in terms of design. It is advantageous, in this regard, if the gripping device can be positioned and moved using very simple movement sequences, for example by means of a two-dimensional movement, so that this gripping device can be structured in very simple and cost-advantageous manner, in terms of design. Thus, if necessary, the rotation device can also be structured in simple manner, in terms of construction, and can be specifically designed for the rotation procedure of the workpiece, so that rotation of the workpiece can also take place very rapidly.

In this regard, the above embodiment by means of a rotation device and a gripping device has the advantage, for example, that the method with the embodiment by means of a gripping device and a rotation device makes available a cost-advantageous and rapid method, which is furthermore also easy to maintain, since the two devices in themselves can be quickly replaced or repaired, and do not have to demonstrate any overly complex construction.

It is also conceivable that the rotation device and gripping device are structured as part of a device that allows both gripping and, using the same device, directly allows rotation. It is easily understood that such a construction is significantly more complicated in terms of design and technology. However, such a device could be structured to be correspondingly space-saving, if the spatial conditions do not allow installation of a separate rotation device, for example.

Also, the stretch rolling method can be characterized in that before rotation, a non-rolled gripping end of the workpiece is grasped by the gripping device, and after rotation, a rolled gripping end is grasped.

At the beginning of rolling, the entire workpiece has not yet been rolled or processed, so that at first the gripping device necessarily grasps a non-rolled gripping end. In the case of stretch rolling methods that correspond to the state of the art, only gripping of the non-rolled gripping end takes place, since this non-rolled gripping end continues to exist even after processing, and rotation is not provided. In the present implementation, in contrast, the gripping device also grips the rolled gripping end, because the workpiece is rotated in the rotation device and, in order to also roll the non-rolled gripping end, the gripping device can grasp the workpiece at the correspondingly other end, in particular, in other words then at the gripping end that has already been rolled.

Because of the fact that the rolled gripping end of the workpiece is also grasped by the gripping device, the non-rolled gripping end can also be rolled, and thereby the complete length of the workpiece can be processed or utilized, so that no non-rolled gripping end remains. In this way, material scrap can be minimized, in particular.

In an alternative embodiment, the gripping device can also grasp the workpiece in a region that has already been rolled, for example, between the rolled and the non-rolled gripping end, as long as rolling out of the non-rolled gripping end is still possible in this regard. Depending on the design of the machine, such gripping can bring with it advantageous spatial conditions, since the gripping device or the grippers can then be structured accordingly. In particular in the case of gripping in the center of the length of the workpiece, a combination with a rotating disk or turntable as the rotation device is advantageous, for example, since the workpiece can be placed centrally on this rotation device in significantly simpler manner.

Also, a stretch rolling method in which a workpiece is successively passed to at least two passes of a stretch rolling unit by means of a gripping device can also be characterized in that the gripping device has two grippers and the grippers are changed between the two passes.

In this regard, the second gripper, in comparison with the first gripper, can be different from the first gripper in terms of its dimension and its shape or gripping shape, so that different sizes and shapes of the gripping ends can be grasped by the respective gripper. This is particularly advantageous if the size or the shape of the workpiece changes after a pass, in such a manner that the first gripper, which has grasped the non-rolled gripping end, for example, can no longer grip the rolled gripping end in operationally reliable manner. In this regard, the second gripper can be structured differently from the first gripper, accordingly, so as to be able to grip the largest possible bandwidth of sizes and shapes of the rolled gripping ends or so as to be able to grip very specific shapes or sizes of the rolled gripping ends.

Thus, for example, the second gripper can be structured in such a manner that it is specifically adapted to a production series or that the second gripper does not need to be replaced for different series, for example, since it is compatible with numerous shapes and diameters. The latter grippers can improve the cycle time, in particular, since a frequent change in grippers between different productions is not necessary.

A stretch rolling unit comprising two stretching rolls that can be driven in opposite directions, having at least two passes and at least one gripping device, which can grip a workpiece at a gripping end and can be brought into at least a first loading position and a first unloading position for the first pass and into a second loading position, and preferably also into a second unloading position for the second pass, can be characterized in that the gripping device can be brought into a start-of-rotation position and into an end-of-rotation position, and that the stretch rolling unit comprises a rotation device that can bring the workpiece from the start-of-rotation position into the end-of-rotation position, by rotating it by 180 degrees about an axis of rotation that lies perpendicular to the main expanse direction of the workpiece.

In this regard, the gripping device is then able, during operation, to bring itself or, in particular, the workpiece into a start-of-rotation position, wherein the gripping device has grasped the workpiece at the non-rolled gripping end and makes the workpiece available, accordingly, for the rotation device to rotate it or by means of take-over by the rotation device. Furthermore, the gripping device can bring itself and, in particular, the workpiece into an end-of-rotation position, wherein the gripping device can grasp the workpiece on its gripping end that has already been rolled, after the rotation procedure.

As a result, transfer of the workpiece from the gripping device to the rotation device can take place in very operationally reliable and rapid manner, and after the rotation procedure by means of the rotation device, transfer of the workpiece from the rotation device to the gripping device can also take place again in very operationally reliable and rapid manner. In this way, an operationally reliable sequence of workpiece rotation can therefore take place, and the time required for this, and consequently also the entire cycle time, can be optimized.

The rotation device is designed in such a manner that here, the workpiece can be brought from the start-of-rotation position into the end-of-rotation position by 180°, by rotating about an axis of rotation that lies perpendicular to a main expanse direction of the workpiece. A corresponding rotation about 180° makes it possible that the ends of the workpiece have been interchanged from the start-of-rotation position in comparison with the end-of-rotation position. Consequently, the gripping device can once again grasp the workpiece, which has been made available by the rotation device, in the end-of-rotation position, wherein the gripping device now grasps the rolled gripping end.

As a result, rotation of the workpiece can take place, so that in the next step, the non-rolled gripping end can also be rolled, and, as has already been explained above, no non-rolled gripping end remains after processing.

Likewise, a stretch rolling unit can also be characterized in that the gripping device is disposed on a manipulator and can be brought into the positions by means of the manipulator. This allows particularly simple implementation of the required movement sequences.

In this regard, the manipulator brings the gripping device and therefore also the workpiece from the passes to the start-of-rotation position, for example, or from the end-of-rotation position back to one of the passes.

It is advantageous if the manipulator is designed for two-dimensional movement sequences, so that the required movement sequences can be implemented in particularly simple manner. Such a two-dimensional movement can be carried out in very operationally reliable and rapid manner, wherein also the acquisition costs and the maintenance costs, such as service and repair costs, can be kept as low as possible.

It is understood that such a manipulator can also be formed by means of rails or an arm or by means of some other kind of robot, for example, wherein these embodiments can bring with them more advantageous design conditions and spatial conditions that are more advantageous with regard to the available space, for example. Also, the examples of manipulators mentioned above can make available great flexibility in their way of work or their function.

Furthermore, the stretch rolling unit can also be characterized in that the start-of-rotation position and the end-of-rotation position are identical, An identical start-of-rotation position and end-of-rotation position bring with them the advantage of simple method management, since the gripping device does not have to be newly positioned so as to take up the workpiece again after rotation. If, for example, a gripper is used that brings itself and thereby also the workpiece into the start-of-rotation position, the workpiece is preferably transferred to the rotation device at this position, since the workpiece is rotated by the rotation device and made available by the rotation device in the end-of-rotation position, so as to transfer the workpiece back to the gripper of the gripping device, which has been situated in the same position during the rotation procedure, so that the gripping device did not have to reposition itself so as to subsequently take over the rotated workpiece again. This optimizes the method sequence significantly, wherein if applicable, the cycle times can also be optimized in this regard.

It is also conceivable that the end-of-rotation position is different from the start-of-rotation position, for example if the workpiece is brought into the start-of-rotation position by means of a first gripper, and a second gripper is supposed to hold the workpiece in the end-of-rotation position. It is understandable that in this regard, the gripping device can be positioned accordingly, so that the start-of-rotation position can be identical to the end-of-rotation position. However, it is also conceivable that it is advantageous, for example due to the structure of the gripping device or rotation device, that for a change from the first gripper to the second gripper, the gripping device is not newly positioned, but rather the gripping device with the two grippers remains in its position, and the rotation device makes available an end-of-rotation position that is different from the start-of-rotation position, wherein the second gripper can take over the rotated workpiece from the new end-of-rotation position, without having to newly position itself.

The rotation device can comprise a turntable or rotating disk. A corresponding turntable or rotating disk can serve for actual implementation of the rotation procedure of the workpiece. Such a turntable or such a rotating disk allows rotation in simple manner, in terms of construction, since the workpiece merely needs to be laid down onto the turntable or rotating disk. If, in this regard, the workpiece is laid down onto the rotating disk or the turntable in centered manner, then the sameness of the start-of-rotation position and of the end-of-rotation position is automatically guaranteed. In this regard, the rotating disk or turntable can also have holding devices or depressions, so as to stabilize the workpiece during rotation.

It is understood that the rotation of the workpiece in the rotation device can also take place by means of other methods.

Furthermore, the rotation device can comprise a gripping apparatus. Such a gripping apparatus can grip a workpiece, for example, that is positioned in the start-of-rotation position, rotate the workpiece, and subsequently bring it back into the end-of-rotation position. Such a gripping apparatus of the rotation device can also guarantee operationally reliable stay of the workpiece on the rotation device, even if a rotating plate or a turntable is used. In this regard, it is prevented that a rotating workpiece on the rotating plate or on the turntable, for example, starts to move.

In particular, rotations about a horizontal axis or also overhead, for example by being gripped from above, become possible, and this further increases the variety of rotation possibilities, which can certainly be advantageous, for example if specific workpiece shapes can only be rotated or can be rotated more advantageously with specific rotations.

A further advantage of a rotation device that comprises a gripping apparatus is that the workpiece can be grasped centrally by the gripping apparatus, so that the sameness of the start-of-rotation position and of the end-of-rotation position occurs automatically.

It is understood that the gripping apparatus can also be provided on a robot arm or the like, if applicable, which then performs the rotation, which in the case of tight spatial conditions, which do not allow a pure rotational movement, possibly still allow rotation by means of the possibility of a dynamic movement sequence.

Also, a stretch rolling unit can be characterized in that the gripping device has a gripper having a gripping diameter that comprises both rolled and non-rolled diameters of a gripping end to be gripped. In this regard, one and the same gripper grips the workpiece, not only at the non-rolled gripping end before rotation but also at the rolled gripping end after rotation. Such an embodiment of the gripper is particularly advantageous, where the gripper can grip both non-rolled and rolled gripping ends without a change in gripper. This reduces the effort in method management and can thereby also improve the cycle time.

A stretch rolling unit comprising two stretching rolls that can be driven in opposite directions, having at least two passes and at least one gripping device that can grip a workpiece at a gripping end and can be brought at least into a first loading position and a first unloading position for the first pass and into a second loading position and preferably also into a second unloading position for the second pass, can also be characterized in that the gripping device has at least two grippers having gripping geometries that are different from one another. As a result, different workpieces, but also workpieces that differ significantly from one another at the ends during the passes can thereby be gripped in operationally reliable manner by the gripping device, in each instance. Thereby the method is not restricted to the effect that only specific changes are allowed to occur after a pass, but rather the grippers can be designed in such a manner that a maximal variety of geometry or size changes can occur on the workpiece during the pass.

Also, the stretch rolling unit can be characterized in that the first of the two grippers has a maximal gripping diameter that lies below the maximal gripping diameter of the second of the two grippers, and a minimal gripping diameter that lies below the gripping diameter of the second of the two grippers.

Such dimensioning of the gripping diameters brings with it an optimal size bandwidth to be gripped, so that using a first and second gripper structured in this manner, it is possible to grip all the diameters that have changed after the pass.

Furthermore, a stretch rolling unit can also be characterized in that the two grippers are kept on hand on a turret or a magazine. It is advantageous if such turrets or magazines comprise numerous grippers having different gripping diameters and gripping geometries, so that accordingly, the suitable gripper can quickly be made available by means of turret or magazine.

It is understood that the characteristics of the independent claims can also be combined so as to be able to implement the corresponding advantages accordingly.

Figure 2:
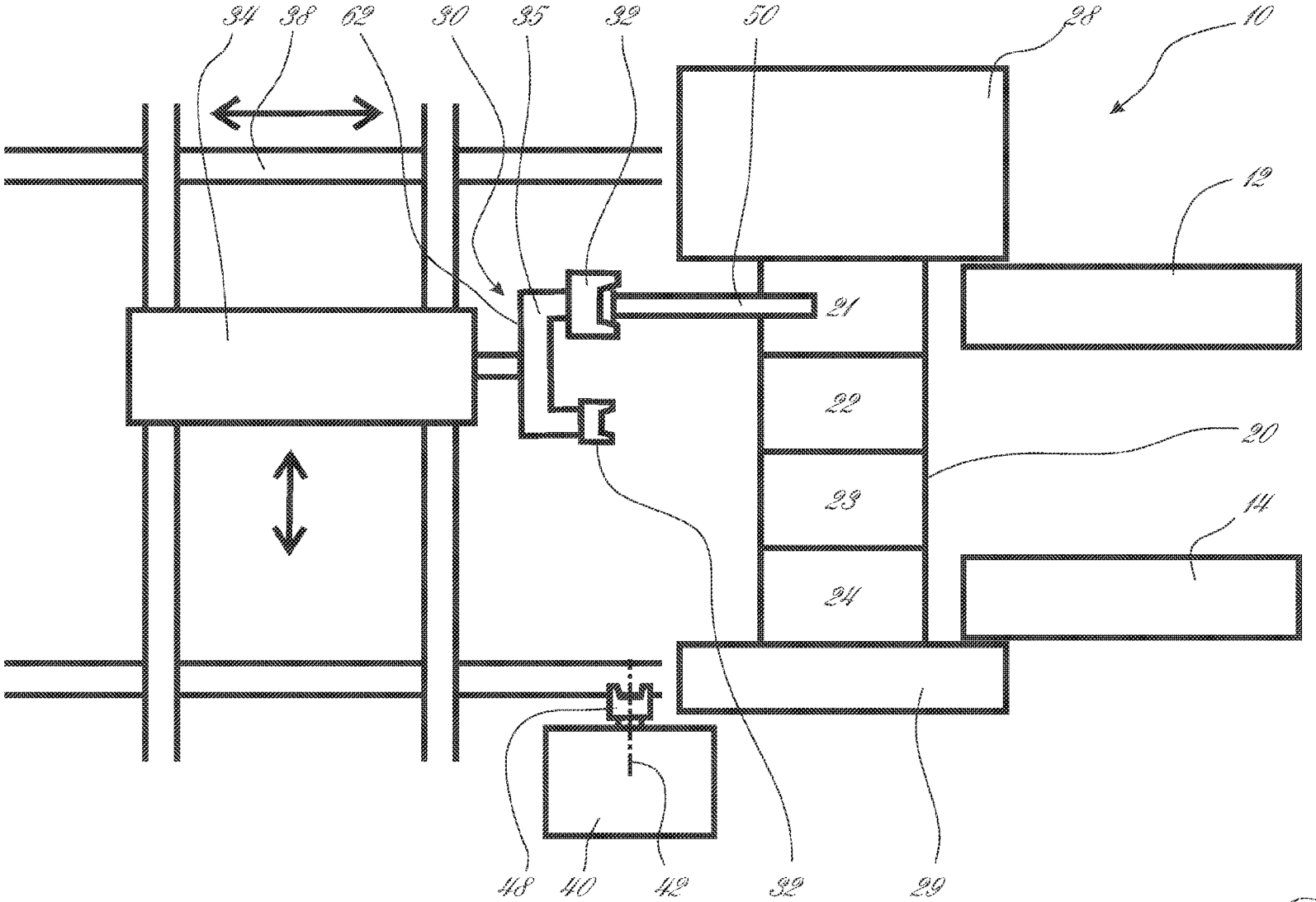
Figure 3:
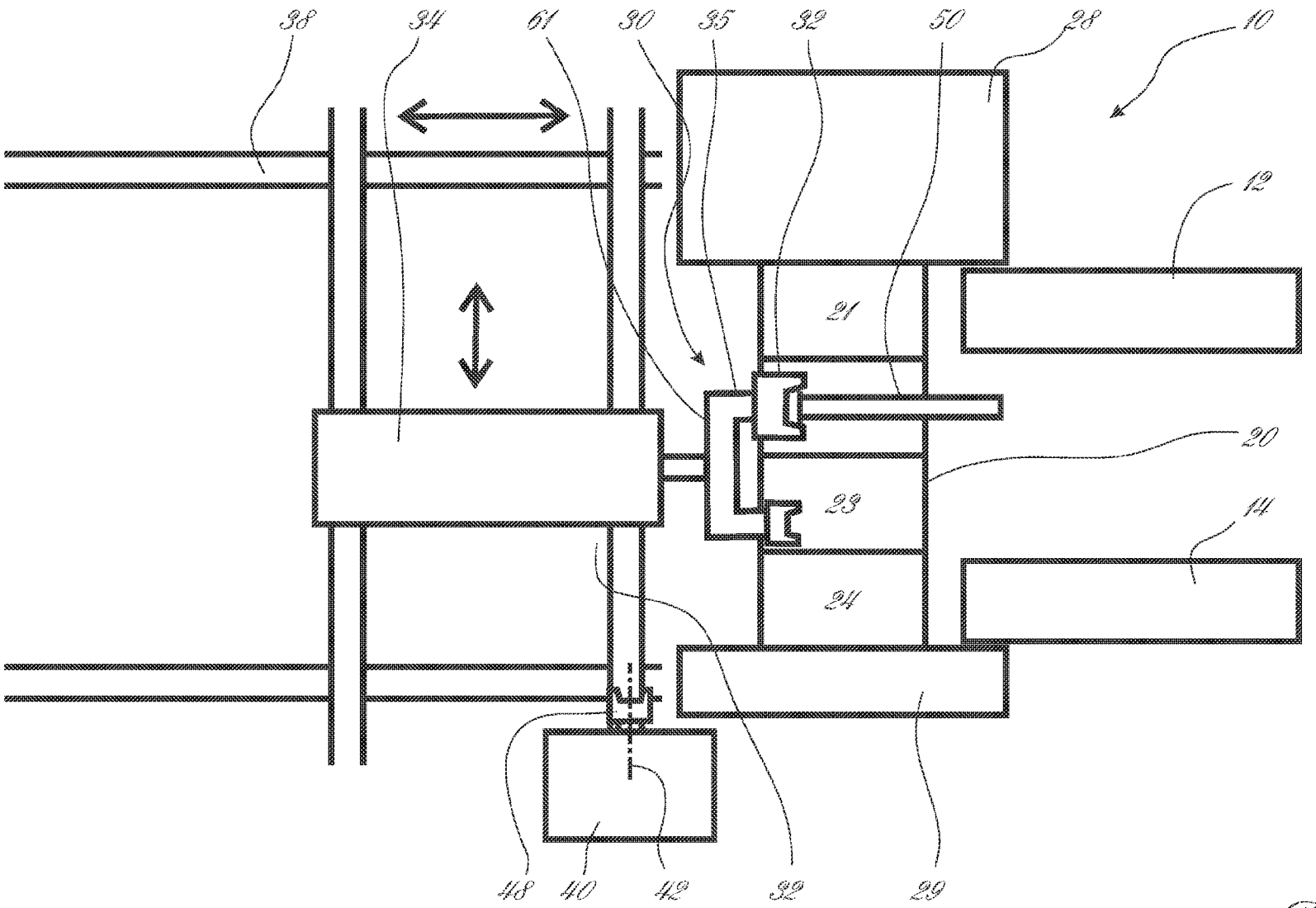
Figure 4:
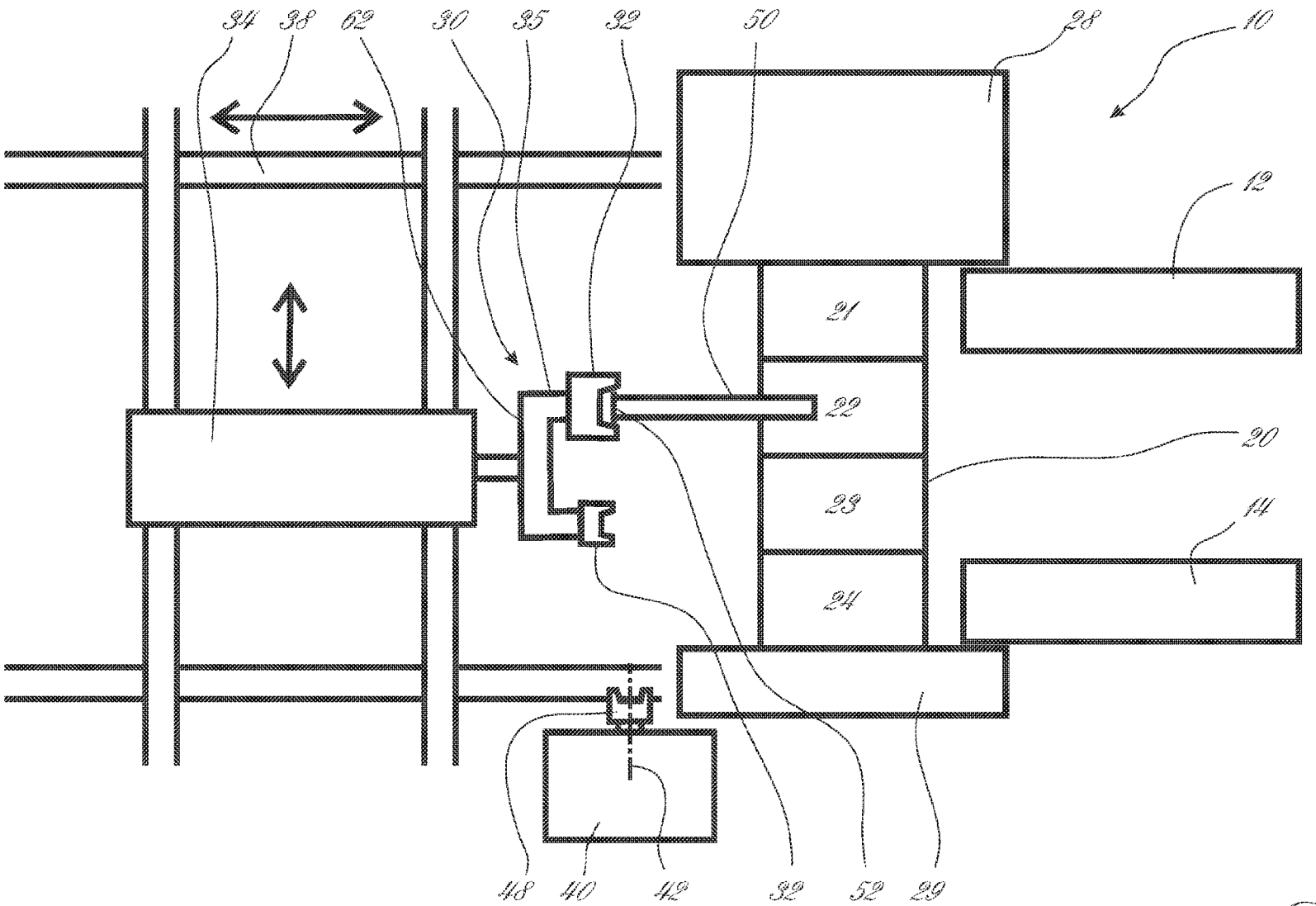
Figure 5:
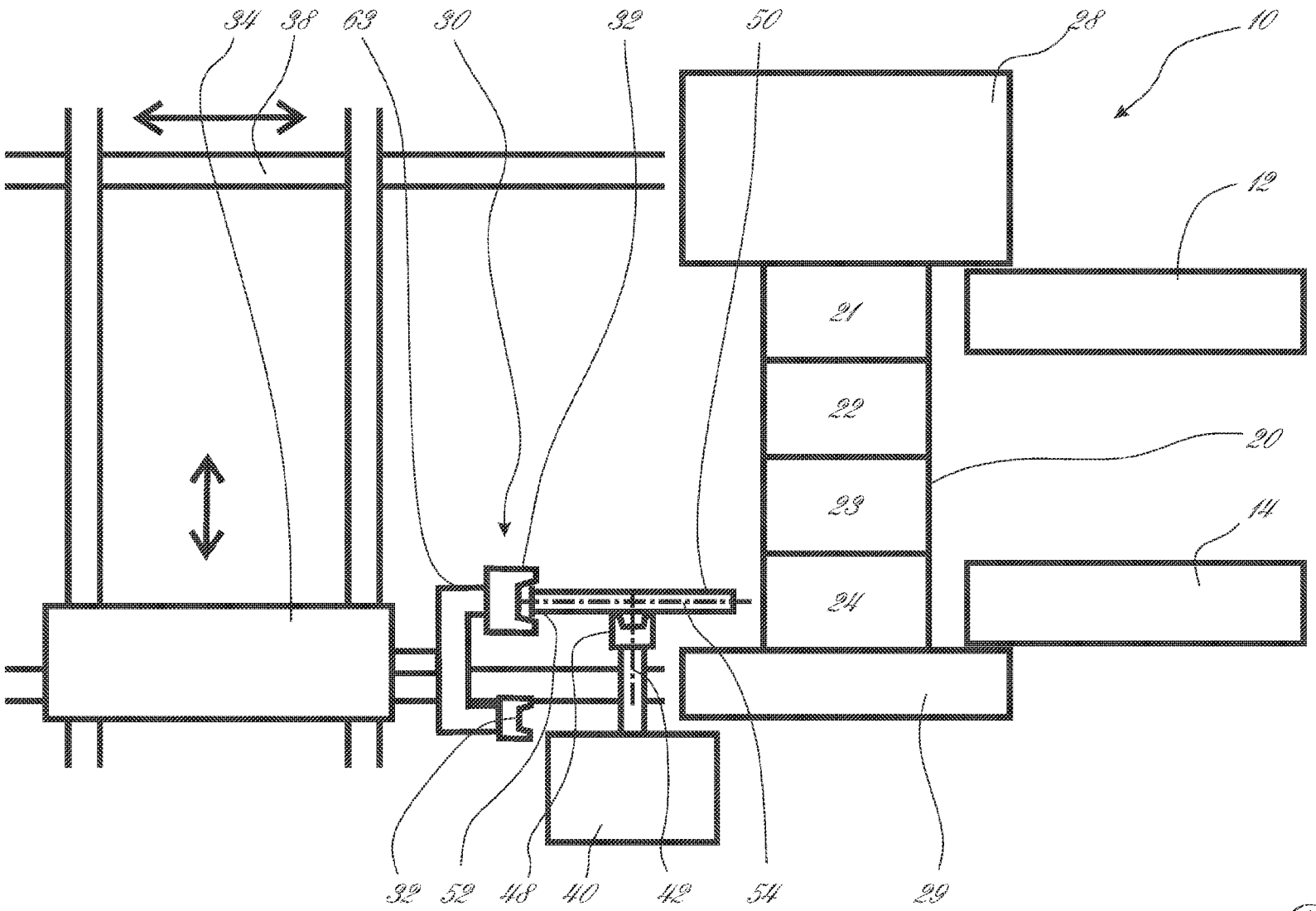
Figure 6:
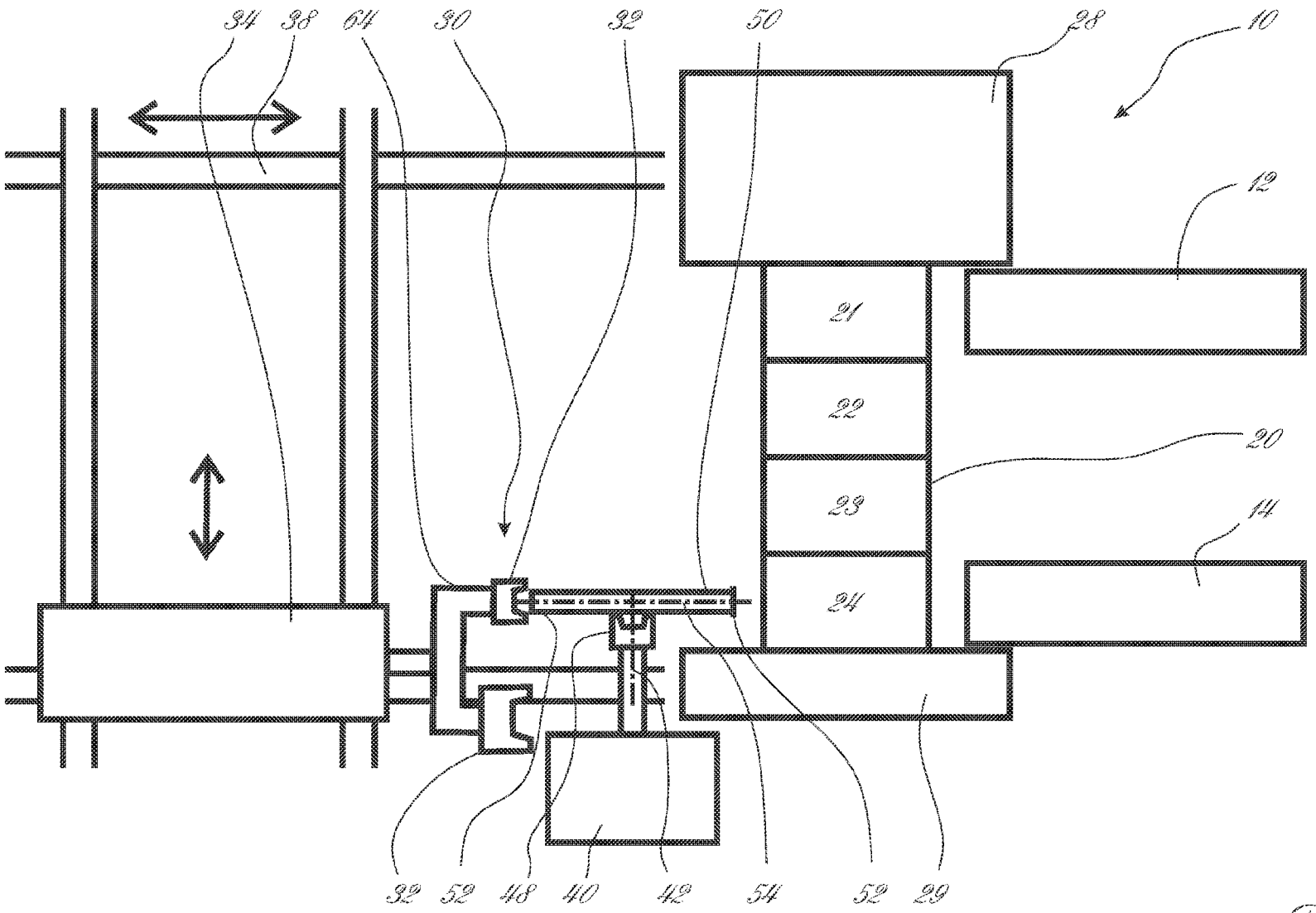
Figure 7:
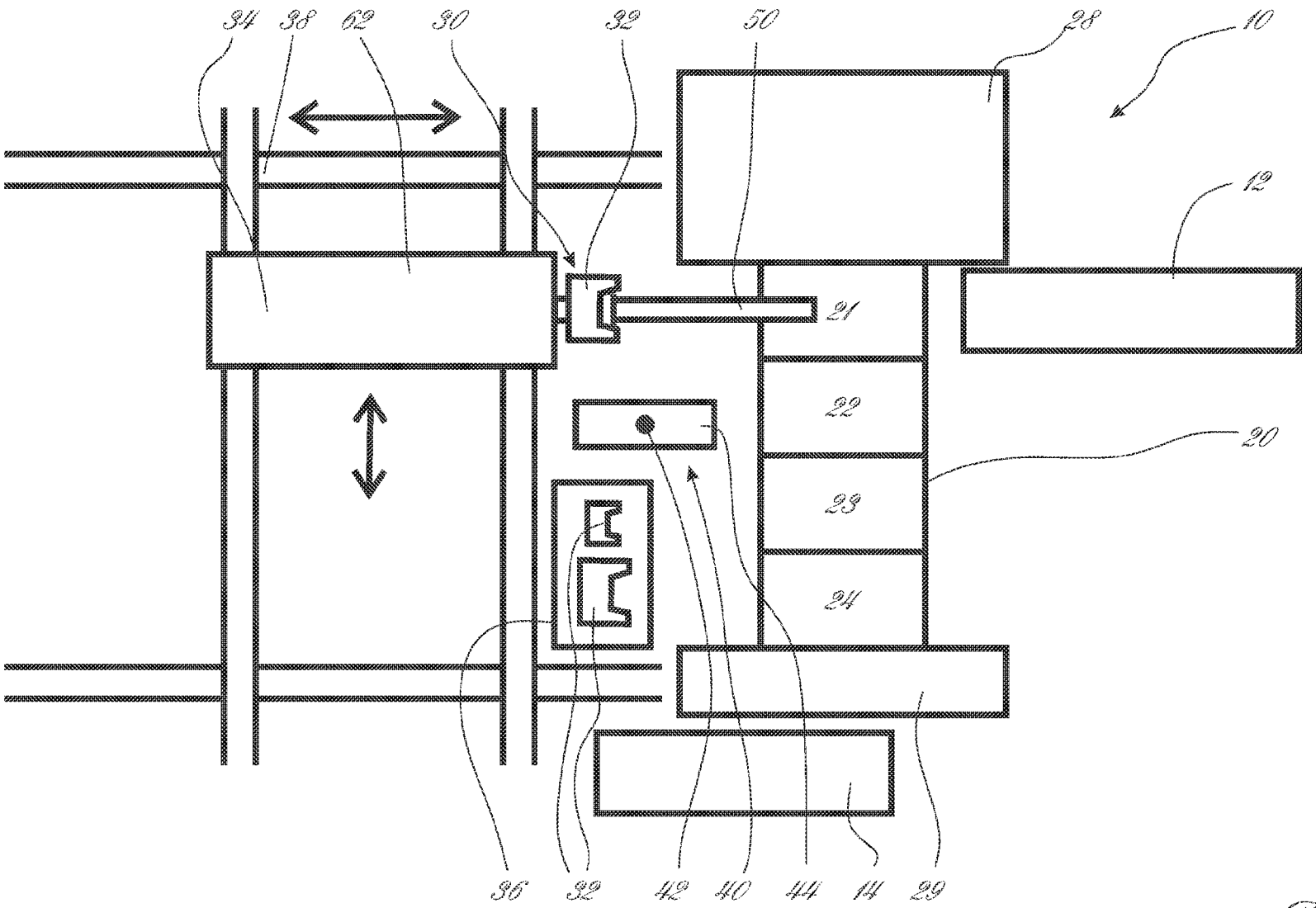
Figure 8:
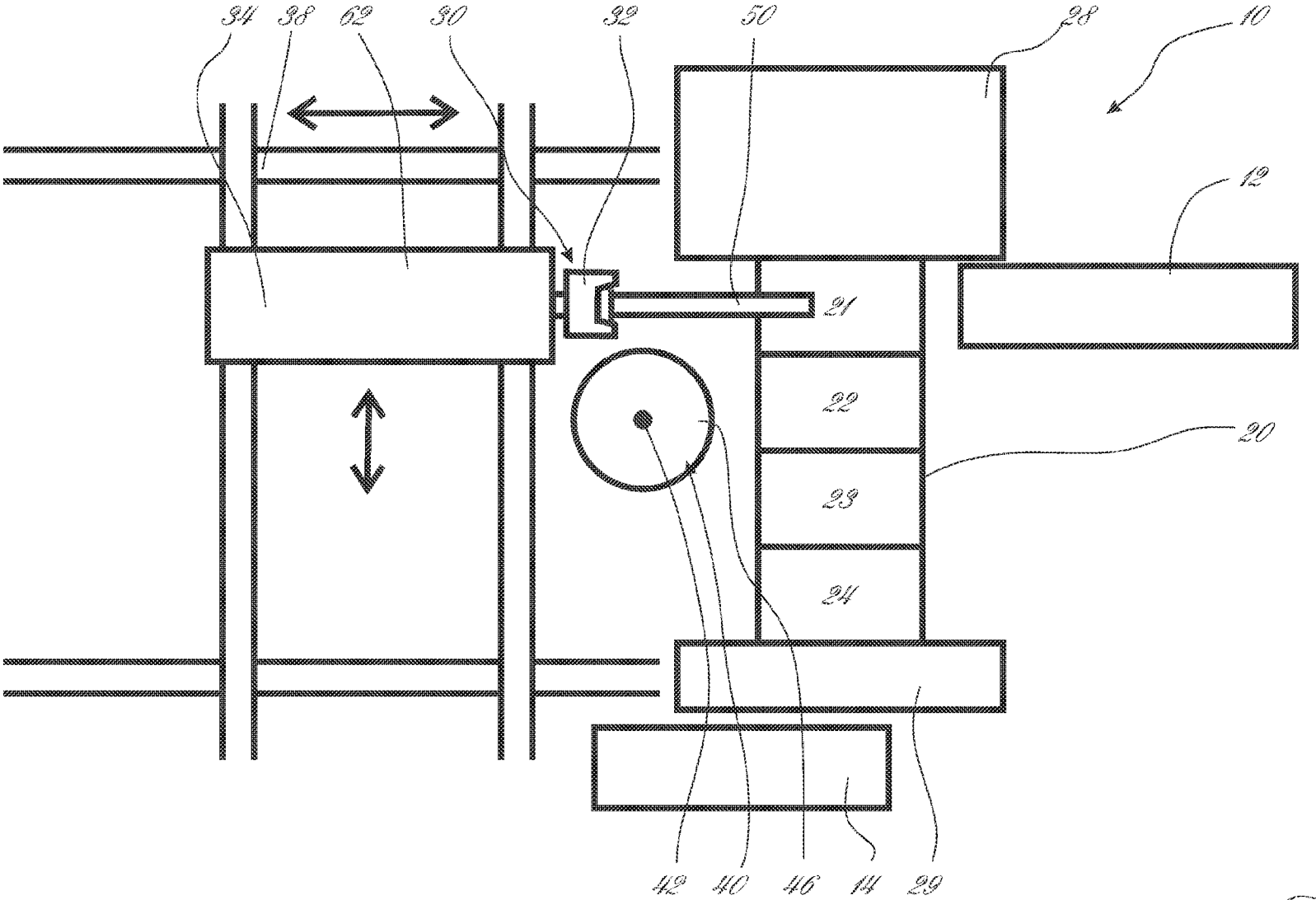
Figure 9:
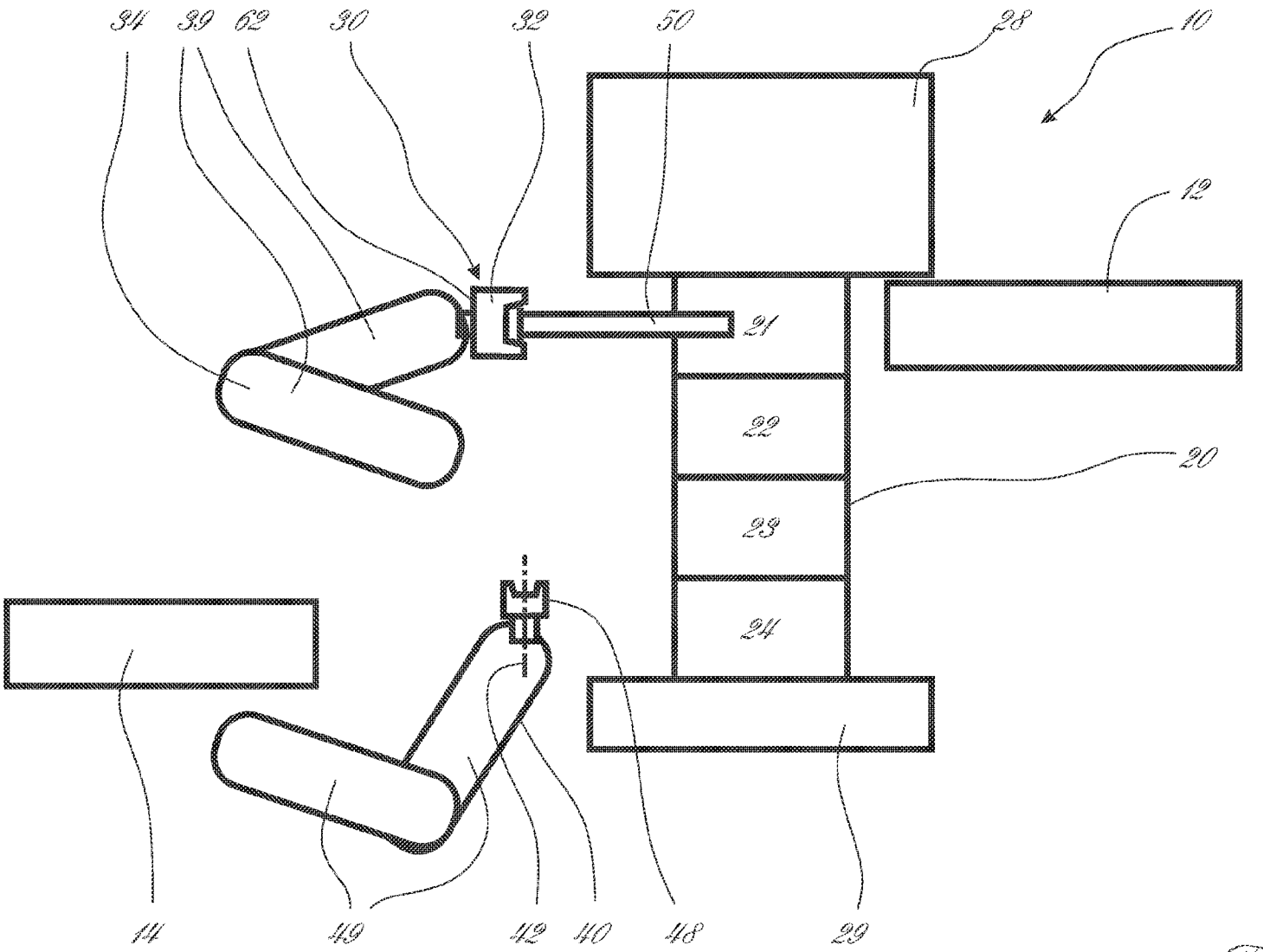

Further advantages, goals, and properties of the present invention will be explained in the following description of the drawing, in which stretch rolling units are shown and stretch rolling methods are clarified, as examples. In the drawing, the figures show:

FIG. 1 a first stretch rolling unit in a schematic top view, with a gripping device and a workpiece in a loading position for the first pass, and the workpiece in a readiness position on a feed mechanism, shown with broken lines;

FIG. 2 the arrangement according to FIG. 1 after the first pass, with the gripping device and the workpiece in a removal position;

FIG. 3 the arrangement according to FIGS. 1 and 2 before the second pass, with the gripping device and the workpiece in a loading position;

FIG. 4 the arrangement according to FIGS. 1 to 3 after the second pass, with the gripping device and the workpiece in a removal position;

FIG. 5 the arrangement according to FIGS. 1 to 4 after the second pass, with the gripping device and the workpiece in a start-of-rotation position;

FIG. 6 the arrangement according to FIGS. 1 to 5 after rotation, with the gripping device and the workpiece in an end-of-rotation position;

FIG. 7 a second stretch rolling unit in a similar state as shown in FIG. 2, wherein, however, instead of a turret, a magazine for different grippers is used, and a turntable having a vertical axis of rotation is used as the rotation device;

FIG. 8 a third stretch rolling unit in a similar state as shown in FIGS. 2 and 7, wherein a gripper having a sufficient gripping width for both an non-rolled and a rolled gripping end is used for gripping, and a turntable having a vertical axis of rotation is used as the rotation device; and FIG. 9 a third stretch rolling unit in a similar state as shown in FIGS. 2, 7, and 8 wherein not only the gripping device but also the rotation device are implemented by way of a manipulator or robot having arms, and the rotation device is also used for deposit onto the removal mechanism.

FIG. 1 shows a first stretch rolling unit 10 in a schematic top view, with a gripping device 30 and a workpiece 50 in a loading position 61 for the first pass 21, as well as the workpiece 50 in a readiness position on a feed mechanism 12, shown with broken lines.

The gripping device 30 consists of a turret 35 as well as the grippers 32.

The gripping device 30 is disposed on a manipulator 34, which, in this exemplary embodiment, can move the gripping device 30 in two dimensions by way of rails 38. The passes 21, 22, 23, 24 are disposed between a drive and main roll bearing 28 and a counter-bearing 29. The readiness position of the workpiece 50, shown with broken lines, is oriented according to the main expanse direction 54 of the workpiece 50. The stretching roll 20 thereby comprises the passes 21, 22, 23, 24 as well as the drive, the main roll bearing 28, and the counter-bearing 29, wherein the discharge mechanism 14 is disposed at the level of the fourth pass 24 on the counter-bearing 29.

The rotation device 40 comprises a separate gripping apparatus 48 as well as an axis of rotation 42 for rotation of the workpiece 50. The rotation device 40 is connected with the manipulator 34 in such a manner that the gripping device 30 can be brought toward the rotation device 40 by means of the manipulator 34.

FIG. 2 shows the basic arrangement according to FIG. 1 after the first pass 21, with the gripping device 30 and the workpiece 50 in an unloading position 62. In this method step, the manipulator 34 has moved the gripping device 30 horizontally away from the stretch rolling unit 10.

In FIG. 3, the arrangement according to FIGS. 1 and 2 is shown before the second pass 22, with the gripping device 30 and the workpiece 50 in a loading position 61. For this purpose, the manipulator 34 has moved the gripping device 30 both horizontally in the direction of the stretching roll 10 and also vertically to the level of the second pass 22.

In FIG. 4, the arrangement according to FIGS. 1 to 3 is shown after the second pass 22, with the gripping device 30 and the workpiece 50 in an unloading position 62. For positioning of the workpiece 50 into the unloading position 62, the manipulator 34 has moved the gripping device 30 and thereby the workpiece 50 horizontally away from the stretching roll.

FIG. 5 shows the arrangement according to FIGS. 1 to 4 after the second pass 22, with the gripping device 30 and the workpiece 50 in a start-of-rotation position 63. The start-of-rotation position 63 is established in such a manner that the main expanse direction 54 of the workpiece 50 lies perpendicular to the axis of rotation 42 of the rotation device 40, and that the workpiece 50 is positioned directly on the gripping apparatus 48 of the rotation device 40. In this regard, the gripper 32 still grips the workpiece 50 at its non-rolled gripping end 52.

In FIG. 6, the arrangement according to FIGS. 1 to 5 is shown after rotation, with the gripping device 30 and the workpiece 50 in an end-of-rotation position 64. In this regard, the end-of-rotation position 64 is identical with the start-of-rotation position 63, which is shown in FIG. 5. As a result of the rotation of the workpiece 50, the non-rolled gripping end 52 is now situated on the opposite side, rotated by 180° about the axis of rotation 42. The end 52 to be gripped is now the end that has already been rolled, due to the rotation, and thereby has a smaller diameter than the non-rolled gripping end 52. For this purpose, the grippers 32 of the gripping device 30 have also be changed by means of turret 35, so that a gripper 32 having a smaller gripping diameter grasps the new gripping end 52.

FIG. 7 shows a second stretch rolling unit 10 in a similar state as shown in FIG. 2, wherein, however, a magazine 36 for different grippers 32 is used, and a turntable 44 having a vertical axis of rotation 42 is used as the rotation device 40, instead of a turret 35. In this regard, rotation of the workpiece 50 can take place in very operationally reliable and simple manner, by means of the turntable 44, wherein instead of a turret 35 from the previous exemplary embodiment making a new gripper 32 available, the gripper 32 is made available by the magazine 36. Therefore, if the newly rolled gripping end 52 has a correspondingly small diameter or a different geometry, the gripper 32 can be replaced with a suitable gripper 32 from the magazine 36, so that a gripper 32 having a different gripping diameter or gripping geometry can grasp the newly rolled gripping end 52 after rotation by means of the rotation device 40.

For rotation of the workpiece 50, the manipulator 34 only has to move the gripping device or the workpiece 50 horizontally and vertically, accordingly, so that the workpiece 50 lies on the turntable 44, so that the workpiece can be rotated by 180° there, very easily and quickly.

FIG. 8 shows a third stretch rolling unit in a similar state as shown in FIGS. 2 and 7, wherein a gripper 32 having a sufficient gripping width for both a non-rolled and a rolled gripping end 52 is used for gripping, and a turntable 46 having a vertical axis of rotation 42 is used as the rotation device 40. If, as shown in this exemplary embodiment, the gripper 32 can grip both the non-rolled and the rolled gripping end 52, the procedure of gripper change is eliminated, which also brings with doing without a turret 35 or a magazine 36, and thereby is better suitable for tight spatial conditions, if applicable. Furthermore, the exemplary embodiment according to FIG. 8 brings with it that the discharge mechanism 14 can be positioned somewhat more advantageously, using a rotating plate 46 as the rotation device 40.

FIG. 9 shows a third stretch rolling unit in a similar condition as shown in FIGS. 2, 7, and 8, wherein not only the gripping device 30 but also the rotation device 40 are implemented by way of manipulators 34 or robots 49 having arms 39, and the rotation device 40 is also used for deposit onto the discharge mechanism 14. A very dynamic movement sequence of the workpiece 50 during the rotation procedure as well as the deposit onto the discharge mechanism is made possible by means of the use of such arms 39 or robot arms as the rotation device 40 or gripping device 30. Furthermore, this embodiment is very advantageous in the case of tight spatial conditions, since the arms 39 or robot arms 40 can be structured to be very flexible, and the movements can be performed on the smallest amount of space.

It is understood that the details of the different exemplary embodiments can be combined in different ways. In the present case, rotation takes place between the second pass 22 and the third pass 23, in each instance. Depending on the concrete application, rotation can also take place, alternatively or cumulatively, between other passes 21, 22, 23, 24. Likewise, the number of passes can be adapted to the needs of the current process, upward from two.

REFERENCE NUMBERS

10 stretch rolling unit
12 feed mechanism
14 discharge mechanism
20 stretching roll
21 first pass
22 second pass
23 third pass
24 fourth pass
28 drive and main roll bearing
29 counter-bearing
30 gripping device
32 gripper
34 manipulator
35 turret
36 magazine
38 rails
39 arm
40 rotation device
42 axis of rotation
44 turntable
46 rotating disk
48 gripping apparatus of the rotation device 40
49 robot arm of the rotation device 40
50 workpiece
52 gripping end
54 main expanse direction of the workpiece 50
61 loading position
62 unloading position
63 start-of-rotation position
64 end-of-rotation position

The invention claimed is:

1. A stretch rolling method in which a workpiece (50) is successively passed by a gripping device to at least two passes (21, 22, 23, 24) of a stretch rolling unit (10) comprising two stretching rolls (20), wherein the workpiece (50) is rotated by 180°, about an axis of rotation (42) that lies perpendicular to a main expanse direction (54) of the workpiece (50), between the first pass (21, 22, 23) of the two passes (21, 22, 23, 24) and the second pass (22, 23, 24) of the two passes (21, 22, 23, 24), and wherein the gripping device (30) is displaced horizontally toward the stretching roll (20) as well as vertically to a height of the second pass (22, 23, 23) before the second pass (22, 23, 24), and (i) wherein the workpiece (50) is brought into a start-of-rotation position (63) by means of a first gripper of the gripping device (30), and a second gripper of the gripping device (30) holds the workpiece (50) in an end-of-rotation position (64), wherein the start-of-rotation position (63) is different from the end-of-rotation position (64), and wherein the second gripper of the gripping device (30) can take over the rotating workpiece from the end-of-rotation position, without having to newly position itself, and (ii) wherein stretch rolling free of gripping ends occurs without a reversal of direction of the stretching rolls (20) between two passes.

2. The stretch rolling method according to claim 1, wherein rotation takes place by way of a rotation device (40), and wherein the gripping device (30) transfers the workpiece (50) to the rotation device (40) for rotation between the passes (21, 22, 23, 24), and takes it over again from the rotation device (40) after rotation.

3. The stretch rolling method according to claim 1, wherein before rotation, a non-rolled gripping end (52) of the workpiece (50) is grasped by the gripping device (30), and after rotation, a rolled end (52) is grasped.

4. A stretch rolling unit (10) comprising two stretching rolls (20) that can be driven in opposite directions, having at least two passes (21, 22, 23, 24) and at least one gripping device (30), which can grip a workpiece (50) at a gripping end (52) and can be brought into at least a first loading position (61) and a first unloading position (62) for the first pass (21, 22, 23) and into a second loading position (61) for the second pass (22, 23, 24), wherein the gripping device (30) can be brought into a start-of-rotation position (63) and into an end-of-rotation position (64), wherein the stretch rolling unit (10) comprises a rotation device (40) that can bring the workpiece (50) from the start-of-rotation position (63) into the end-of-rotation position (64), by rotating it by 180° about an axis of rotation (42) that lies perpendicular to a main expanse direction (54) of the workpiece (50), wherein the gripping device (30) can be moved horizontally toward the stretching roll (20) as well as vertically to a level of the second pass (22, 23, 24) for the second pass (22, 23, 24), and (i) wherein a first gripper of the gripping device (30) is configured to bring the workpiece (50) into the start-of-rotation position (63), and a second gripper of the gripping device (30) is configured to hold the workpiece (50) in the end-of-rotation position (64), wherein the start-of-rotation position (63) is different from the end-of-rotation position (64), and wherein the second gripper of the gripping device (30) can take over the rotating workpiece from the end-of-rotation position, without having to newly position itself, and (ii) wherein stretch rolling free of gripping ends occurs without a reversal of direction of the stretching rolls between two passes.

5. The stretch rolling unit (10) according to claim 4, wherein the gripping device (30) is disposed on a manipulator (34) and can be brought into the positions (61, 62, 63, 64) by means of the manipulator (34).

6. The stretch rolling unit (10) according to claim 4, wherein the start-of-rotation position (63) and the end-of-rotation position (64) of the gripping device during rotation of the workpiece by the rotation device are identical.

7. The stretch rolling unit (10) according to claim 4, wherein the rotation device (40) comprises a turntable (44) or rotating plate (46).

8. The stretch rolling unit (10) according to claim 4, wherein the rotation device (40) comprises a gripping apparatus (48).

9. The stretch rolling unit (10) according to claim 5, wherein the gripping device (30) has a gripper (32) having a gripping diameter that comprises both rolled and non-rolled diameters of a gripping end (52) to be gripped.

10. A stretch rolling method for the production of railroad axles in which a workpiece (50) is successively passed by a gripping device to at least two passes (21, 22, 23, 24) of a stretch rolling unit (10), wherein the workpiece (50) is rotated by 180°, about an axis of rotation (42) that lies perpendicular to a main expanse direction (54) of the workpiece (50), between the first pass (21, 22, 23) of the two passes (21, 22, 23, 24) and the second pass (22, 23, 24) of the two passes (21, 22, 23, 24), and wherein the gripping device (30) is displaced horizontally toward the stretching roll (20) as well as vertically to a height of the second pass (22, 23, 23) before the second pass (22, 23, 24), and wherein before rotation, a non-rolled gripping end (52) of the workpiece (50) is grasped by the gripping device (30), and after rotation, a rolled end (52) is grasped, and wherein one and the same gripper of the gripping device grips the workpiece, not only at the non-rolled gripping end before rotation but also at the rolled gripping end after rotation, and wherein stretch rolling free of gripping ends occurs without a reversal of direction of the stretching rolls between two passes.

11. The stretch rolling method according to claim 10, wherein rotation takes place by way of a rotation device (40), and wherein the gripping device (30) transfers the workpiece (50) to the rotation device (40) for rotation between the passes (21, 22, 23, 24), and takes it over again from the rotation device (40) after rotation.

12. A stretch rolling unit (10) for the production of railroad axles comprising two stretching rolls (20) that can be driven in opposite directions, having at least two passes (21, 22, 23, 24) and at least one gripping device (30), which can grip a workpiece (50) at a gripping end (52) and can be brought into at least a first loading position (61) and a first unloading position (62) for the first pass (21, 22, 23) and into a second loading position (61) for the second pass (22, 23, 24), wherein the gripping device (30) can be brought into a start-of-rotation position (63) and into an end-of-rotation position (64), wherein the stretch rolling unit (10) comprises a rotation device (40) that can bring the workpiece (50) from the start-of-rotation position (63) into the end-of-rotation position (64), by rotating it by 180° about an axis of rotation (42) that lies perpendicular to a main expanse direction (54) of the workpiece (50), and wherein the gripping device (30) can be moved horizontally toward the stretching roll (20) as well as vertically to a level of the second pass (22, 23, 24) for the second pass (22, 23, 24), and wherein the gripping device (30) has a gripper (32) having a gripping diameter that comprises both rolled and non-rolled diameters of a gripping end (52) to be gripped, and wherein stretch rolling free of gripping ends occurs without a reversal of direction of the stretching rolls between two passes.

13. The stretch rolling unit (10) according to claim 12, wherein the gripping device (30) is disposed on a manipulator (34) and can be brought into the positions (61, 62, 63, 64) by means of the manipulator (34).

14. The stretch rolling unit (10) according to claim 12, wherein the start-of-rotation position (63) and the end-of-rotation position (64) of the gripping device during rotation of the workpiece by the rotation device are identical.

15. The stretch rolling unit (10) according to claim 12, wherein the rotation device (40) comprises a turntable (44) or rotating plate (46).

16. The stretch rolling unit (10) according to claim 12, wherein the rotation device (40) comprises a gripping apparatus (48).

* * * * *